US008387605B2

(12) United States Patent
Brown et al.

(10) Patent No.: US 8,387,605 B2
(45) Date of Patent: Mar. 5, 2013

(54) TOY DART LAUNCHER APPARATUS WITH MOMENTARY LOCK

(75) Inventors: Robert L. Brown, North Kingstown, RI (US); Raymond Aaron Mead, Pawtucket, RI (US); Brian Jablonski, Providence, RI (US)

(73) Assignee: Hasbro, Inc., Panotucket, RI (US)

( * ) Notice: Subject to any disclaimer, the term of this patent is extended or adjusted under 35 U.S.C. 154(b) by 735 days.

(21) Appl. No.: 12/545,253

(22) Filed: Aug. 21, 2009

(65) Prior Publication Data

US 2011/0041821 A1 Feb. 24, 2011

(51) Int. Cl.
*F41B 7/08* (2006.01)
*F41A 17/48* (2006.01)

(52) U.S. Cl. ..... 124/27; 124/40; 124/63; 124/64; 124/66; 446/473

(58) Field of Classification Search ..... 124/27, 124/40, 63, 64, 66; 446/473
See application file for complete search history.

(56) References Cited

U.S. PATENT DOCUMENTS

| | | | | | |
|---|---|---|---|---|---|
| 1,136,470 | A * | 4/1915 | Lefever | 124/67 |
| 1,856,285 | A * | 5/1932 | Le Fever | 124/66 |
| 2,097,866 | A * | 11/1937 | Tomlinson | 124/67 |
| 3,476,100 | A * | 11/1969 | Carbonneau | 124/27 |
| 3,859,977 | A * | 1/1975 | Lange | 124/66 |
| 3,949,731 | A * | 4/1976 | Caso | 124/27 |
| 3,963,017 | A * | 6/1976 | Pfotenhauer | 124/21 |
| 4,289,109 | A * | 9/1981 | D'Andrade | 124/67 |
| 4,834,059 | A * | 5/1989 | Moorhouse et al. | 124/67 |
| 5,284,274 | A * | 2/1994 | Lee et al. | 222/79 |
| 5,381,928 | A * | 1/1995 | Lee et al. | 222/79 |
| 5,529,050 | A * | 6/1996 | D'Andrade | 124/56 |
| 5,553,598 | A * | 9/1996 | Johnson et al. | 124/63 |
| 5,671,560 | A * | 9/1997 | Meller | 42/70.11 |
| 5,787,869 | A * | 8/1998 | Johnson et al. | 124/69 |
| 5,791,326 | A * | 8/1998 | Brown et al. | 124/66 |
| 6,256,917 | B1 * | 7/2001 | Findlay | 42/70.06 |
| 6,439,216 | B1 * | 8/2002 | Johnson et al. | 124/70 |
| 6,510,639 | B2 * | 1/2003 | McMoore | 42/70.06 |
| 6,775,941 | B1 * | 8/2004 | McNulty, Jr. | 42/70.11 |
| 6,889,459 | B1 * | 5/2005 | Salvitti | 42/70.08 |
| 7,267,118 | B2 * | 9/2007 | Eddins et al. | 124/63 |
| 7,287,526 | B1 * | 10/2007 | Bligh et al. | 124/63 |
| 7,481,209 | B1 * | 1/2009 | Bligh et al. | 124/63 |
| 7,588,023 | B2 * | 9/2009 | Kung et al. | 124/27 |
| 2003/0069091 | A1 * | 4/2003 | Wengert | 473/409 |
| 2010/0282227 | A1 * | 11/2010 | Vanek | 124/27 |
| 2012/0125304 | A1 * | 5/2012 | Brooks et al. | 124/52 |

* cited by examiner

*Primary Examiner* — Alvin Hunter
*Assistant Examiner* — Alexander Niconovich
(74) *Attorney, Agent, or Firm* — Perry Hoffman

(57) ABSTRACT

A launcher apparatus for soft foam toy darts, the apparatus having a lock that operates momentarily during a cock and load cycle of the launcher apparatus to prevent an improper cocking operation. The launcher apparatus includes a barrel, a slide, a firing assembly and the lock. The launcher apparatus also includes three protrusions or surfaces for operative engagement with the lock to partially depress the lock, to fully depress the lock, and to disengage the lock to reset the launcher apparatus for the next cock and load cycle. During operation, one protrusion surface depresses the lock partially and momentarily, a second protrusion or surface fully depresses the lock to enable the lock to be maintained in the depressed state, and a third protrusion or surface causes the lock to be released.

20 Claims, 13 Drawing Sheets

TOY DART LAUNCHER APPARATUS WITH MOMENTARY LOCK

FIELD OF THE INVENTION

The present invention relates generally to a toy dart launcher apparatus with a lock, and, more particularly, to a toy apparatus that simulates a pump action rifle, but the toy apparatus discharges a soft foam toy dart, and includes a lock that operates momentarily to prevent jamming of the darts in the launcher apparatus.

BACKGROUND OF THE INVENTION

Toys are often designed to have play value by simulating a real object but in a safe manner and at a reasonable expense. Guns and rifles have been marketed as toys for decades and include such devices as water pistols and rifles, cap guns, BB guns and rifles, dart guns and NERF TM brand launchers that discharge a soft foam toy dart. Attempts to design a NERF brand launcher to simulate a sub-machine or Tommy gun have run into a major problem. The soft foam of a NERF brand dart compresses and/or distorts when pressed together with another dart or when packed against a harder surface, so that jamming of the darts prevents proper operation of the launcher apparatus.

Gun locking devices are known for real guns and rifle as disclosed in several existing patents. By way of example, see U.S. Pat. No. 5,671,560 for a "Firearm With Safety Device" issued in 1997 to Meller, which purports to disclose a lock to disable a firearm from firing a cartridge. The device operates a latch that is extended or retracted to lock or unlock the firearm. In the case of a pump-action rifle, the device is placed in a wooden hand guard covering a sliding lever to enable the latch to extend into a hole in a fixed tubular magazine. When locked, the sliding lever is inoperable and hence the rifle cannot be cocked and loaded. U.S. Pat. No. 6,256,917 for a "Lockable Safety For Firearms" issued in 2001 to Findlay, purports to disclose a rotatable cylinder having a notch in a portion of its circumference. The cylinder is placed behind a trigger mechanism, and when locked prevents the trigger from moving rearward. When unlocked, the notch is behind the trigger and sufficient room is provided for the trigger to move fully in the usual manner. U.S. Pat. No. 6,510,639 for a "Firearm Safety Lock" issued in 2003 to McMoore, purports to disclose a lock within a firearm grip to provide a mechanical interruption to the trigger mechanism in the well-known Colt Government Model 1911 automatic pistol that has a palm grip safety and a linear action trigger. U.S. Pat. No. 6,775,941 for a "Built-In Gun Lock For A Pump-Action Shotgun" issued in 2004 to McNulty, Jr., purports to disclose a key operated swivel arm mounted to a slide arm of the shotgun which rotates 90° between a non interference location to allow operation of the gun and an interference location which causes an abutment between the swivel arm and a blocking ring when there is an attempt to use the slide arm to cock the gun. U.S. Pat. No. 6,889,459 for a "Model 1911 Type Firearm Safety Lock" issued in 2005 to Salvitti, purports to disclose a lock device which blocks a hammer rod from moving and thereby blocks movement of the firearm's hammer.

These patents are of some interest, however, they describe devices that are purely safety features that prevent the gun or rifle from any normal operation until the device is removed or opened, and after removal or being opened, the gun operates in a typical manner without interruption. The lock device has no further function until after use of the gun is completed. The lock devices for real guns and rifles also tend to be overly complicated and expensive and thus are not appropriate for toy guns and rifles, and of more importance, do not function to prevent jamming.

SUMMARY OF THE INVENTION

In accordance with the present invention, an advantageous method and apparatus are provided in the form of a toy dart launcher apparatus with a lock that simulates a Tommy gun. The launcher apparatus operates without a motor or batteries, but instead operates like a pump action rifle. The toy launcher apparatus of the present invention discharges soft foam toy darts and operates with a slide to cock and load the apparatus such that only one soft foam toy dart is loaded and discharged per operation of the slide and a trigger. The described embodiments include a barrel, a firing assembly, a slide and a lock. Unlike a real gun lock that makes the gun or rifle inoperative until unlocked, and then the lock has no further function during operation of the gun, the lock of the present invention changes configurations as the user operates the apparatus and operates only momentarily during the cock and load cycle. The slide of the apparatus moves back and forth and operates the lock only momentarily for the express purpose of preventing the slide from moving forward after it has moved rearward a predetermined distance. This prevents toy darts from squeezing together and/or distorting to jam the launcher apparatus. As a user continues to move the slide rearward, the lock is moved out of way, and when the user moves the slide forward the lock is reset for the next lock and load cycle. Hence, the lock is first deployed to prevent a predetermine movement of the slide, then the lock is moved out of the way to allow the slide to complete a cock and load cycle, and thereafter, the lock resets for the next cycle, all in the short time that the apparatus is cocked and loaded.

A major feature of the present invention is that a user must first move the slide fully rearward to cock the launcher apparatus and then forward to load the apparatus and reset the lock. The lock prevents a rearward moving slide from moving forward until the slide reaches a predetermined rearward position. Only then may the slide be moved forward to its start position. The launcher apparatus also has the advantages of being relatively simple, easy to operated, inexpensive and structurally robust.

Briefly summarized, the invention relates to a toy launcher apparatus including a barrel structured to receive toy projectiles, a firing structure operatively connected to the barrel to enable the toy projectiles to be discharged from the launcher apparatus, a slide operatively connected to the firing structure to enable a launch spring to be compressed, the slide being moveable between a forward position and a rearward position, and a lock structure operatively connected to the slide to enable the slide to move from the forward position toward the rearward position and to prevent the slide from moving back to the forward position after the slide has moved rearward a predetermined distance until after the slide has reached the rearward position.

The invention also relates to a method for selectively blocking movement of a slide of a toy launcher apparatus during a cock and load cycle, the method including the steps of moving the slide from a first position toward a second position, passing the slide by a lock wherein a first spring biased abutment structure of the lock is partially depressed, biasing the first abutment structure of the lock into a slide blocking position after the slide has passed the first abutment structure to prevent the slide from moving back toward the first position, and thereafter depressing the first abutment structure sufficiently to prevent the first abutment structure from being biased into a slide blocking position, the first abutment structure being restrained by a second spring biased abutment structure.

BRIEF DESCRIPTION OF THE DRAWINGS

For the purpose of facilitating an understanding of the invention, the accompanying drawings and description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
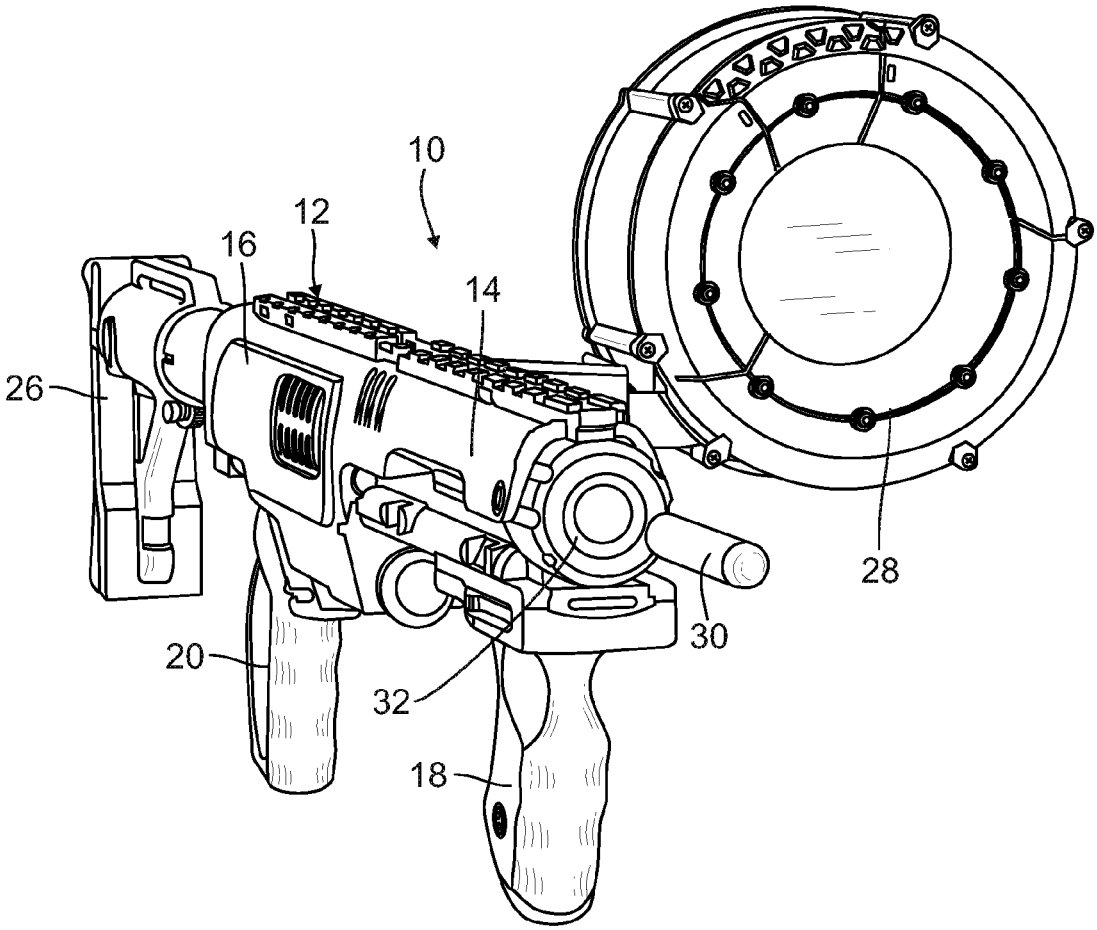
FIG. 1 is a front isometric view of a preferred embodiment of the present invention in the form of a toy launcher apparatus that simulates a Tommy gun and operates like a pump action rifle having a multiple dart magazine.
Figure 2:
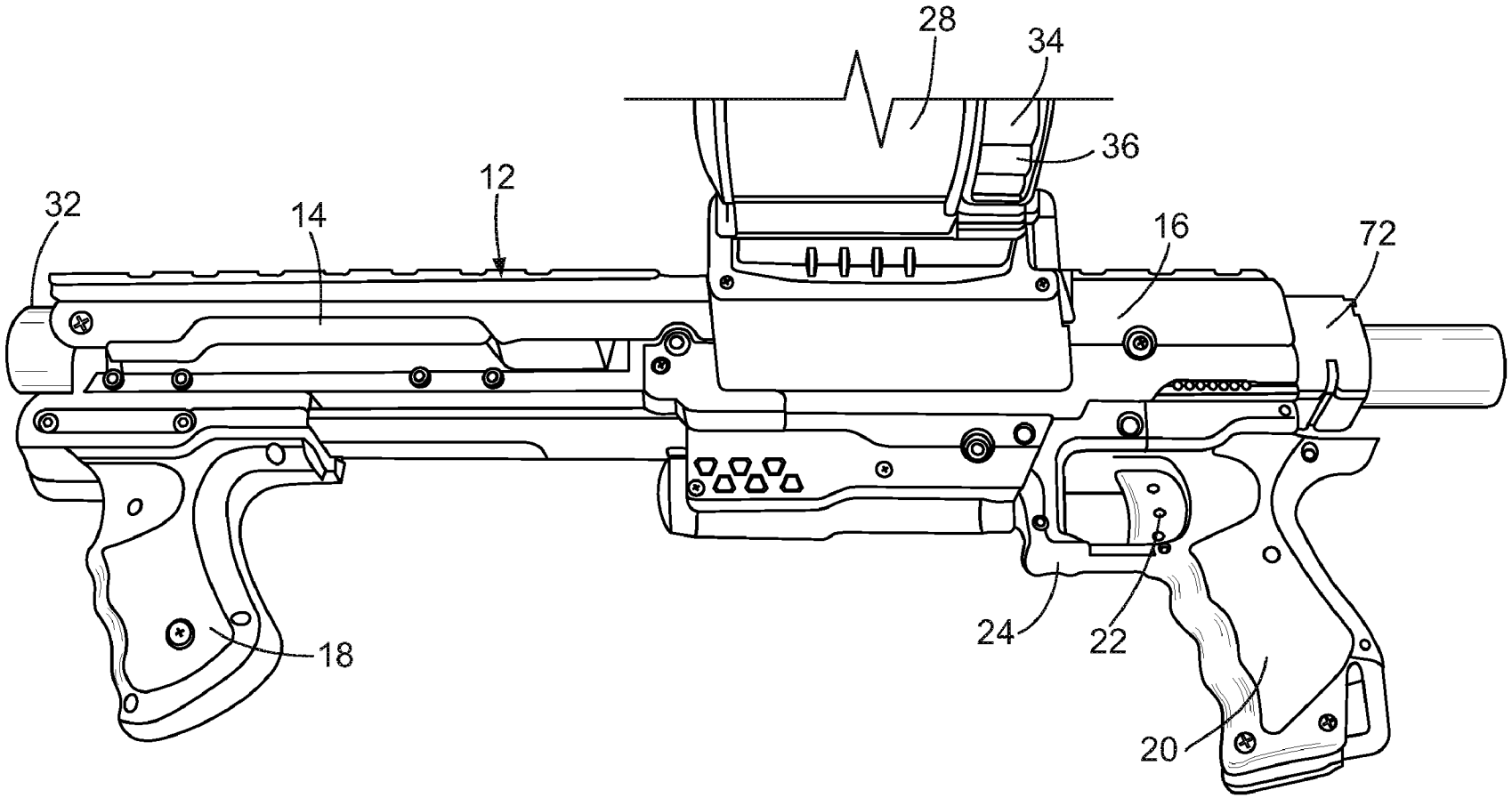
FIG. 2 is a side isometric view of a portion of the toy launcher apparatus.

Referring now to the Figures, FIGS. 1 and 2, there is shown an embodiment of the invention in the form of a toy launcher apparatus 10 configured in the form of a stylized Tommy gun, but operated like a pump-action rifle. The launcher apparatus includes an outer housing 12 that includes a barrel portion 14 and a body portion 16. The launcher apparatus 10 also includes a forward located slide, slide structure, or slide assembly 18, a pistol grip 20, a trigger 22, a trigger guard 24, a stock 26 and a "cartridge" magazine 28. Toy darts loaded into the magazine 28 are a made of soft foam marketed under the NERF TM brand, and a toy dart 30 is shown being discharged in FIG. 1, from a forward end 32 of the launcher apparatus 10. Additional darts 34, 36, FIG. 2, are partially visible in the magazine 28. The stock 26 is connected at the rear of the launcher apparatus and is adjustable and removable. The stock 26 is shown in FIG. 1, but has been removed for added clarity from the view shown in FIG. 2.

As described herein, the launcher apparatus 10 provides its below described lock or lock assembly operatively connected to the slide to enable the slide 18 to be moved from a first position to a second position, and to enable return movement of the slide 18 to the first position after the slide reaches the second position. Further the lock is operatively connected with the slide to momentarily prevent return movement of the slide structure to the first position after the slide reaches a predetermined position between the first and the second positions where the slide moves from the first position to the second position. During operation the lock assembly operates momentarily during the cock and load cycle of the launcher apparatus 10 to prevent improper cocking operation. Throughout this disclosure, the words, such as, "forward," "rearward," "upper" and "lower," and like terms, refer to an attitude of the launcher apparatus as it is viewed in the drawings, and as the launcher apparatus will typically be held during play while being operated by a user.

Figure 3:
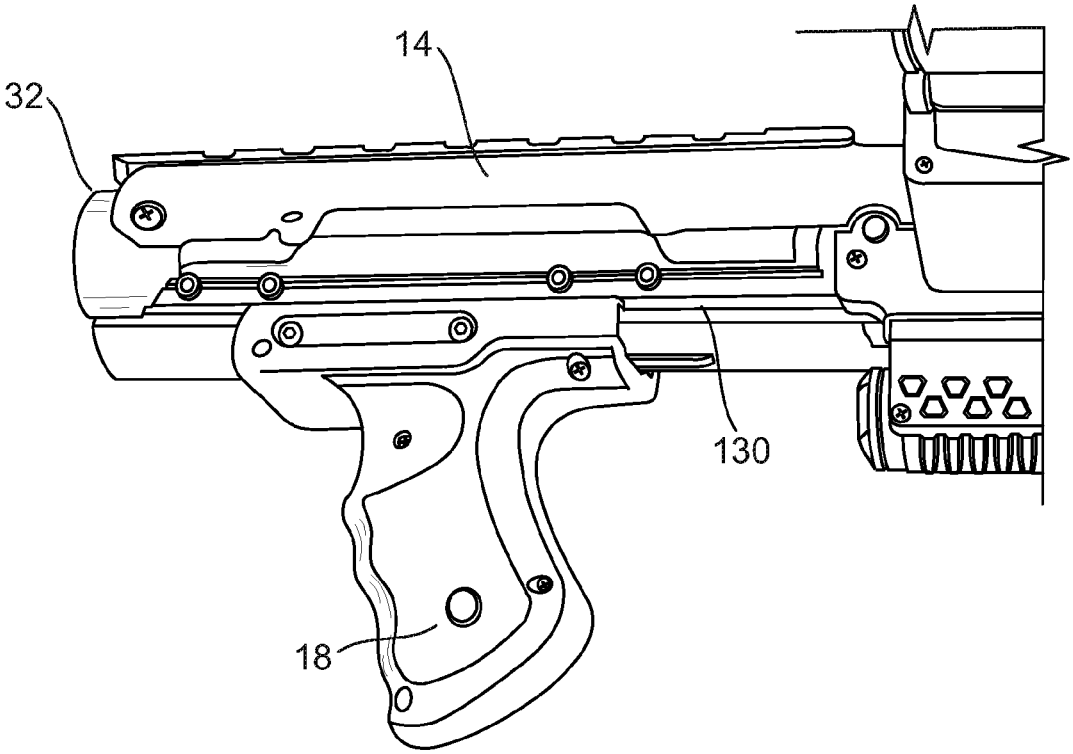
FIG. 3 is a side isometric view of a smaller portion of the toy launcher apparatus showing the apparatus at a predetermined, no return configuration.

As with a real pump-action rifle, the launcher apparatus 10 also operates by using a "pump action" to cock and load the toy as will be explained in more detail below. In FIG. 2, the launcher apparatus 10 is shown at rest or before the start of a cock and load cycle, with the slide assembly 18 located in a forward or first position near the forward end 32 of the launcher apparatus 10. In FIG. 3, the slide assembly 18 is shown in a predetermined mid position, having been moved rearward to approximate a half-cocked position, and in FIG. 4, the slide assembly 18 is shown in a rearward or second position, when the launcher apparatus is fully cocked. "Fully cocked" is defined to mean that a launch spring within the housing has been compressed to provide the energy for discharging a toy dart. Once the launcher apparatus has been fully cocked, the slide assembly 18 must be returned to the forward position by a user, and this results in a dart being loaded. After the cock and load cycle is completed, squeezing the trigger will release the compressed launch spring to cause the dart to be discharged from the launcher apparatus.

Figure 4:
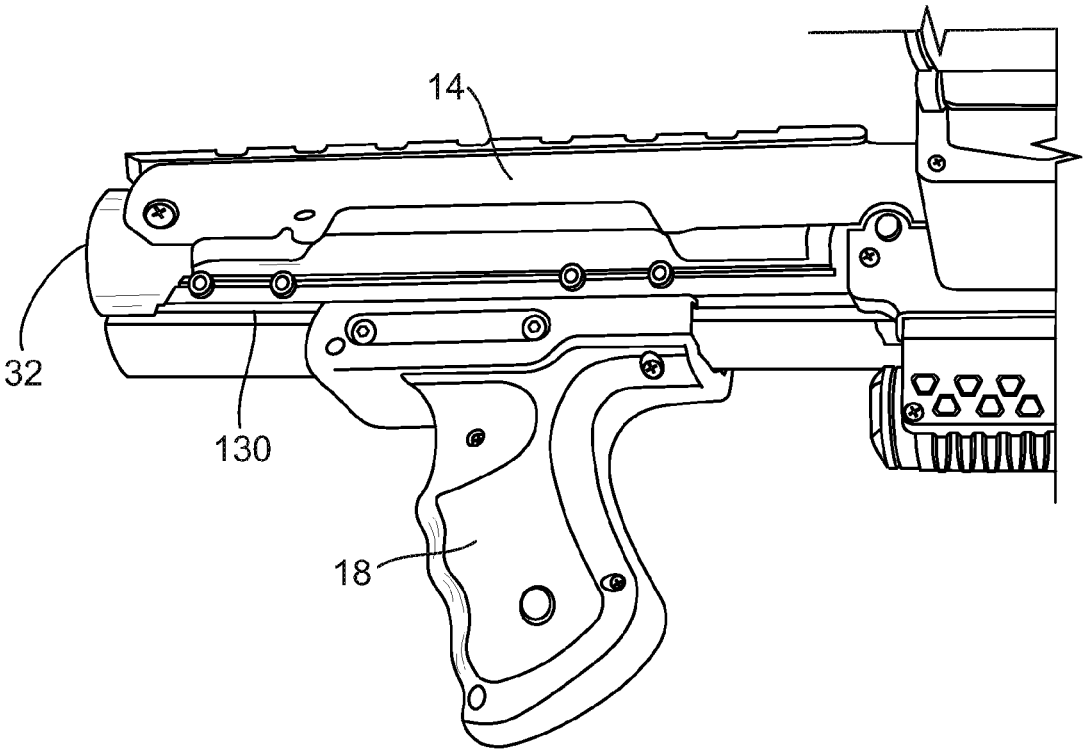
FIG. 4 is a side isometric view of the smaller portion of the toy launcher apparatus shown in FIG. 3, showing the apparatus at a "fully-cocked" configuration.

Within the interior of the launcher apparatus 10 there are several structures and various assemblies or mechanisms. Assigning structures to specific assemblies in this disclosure is a matter of convenience and done for clarity and should not be considered limiting in any way. It is to be noted that some structures assigned here to one assembly may be included in other assemblies as will be identified, or the structures may be viewed individually without any specific assignment to an assembly. One of the structural elements or assemblies is a lock or lock assembly, an important feature of the launcher apparatus, which will be described in more detail below. The lock functions during the cock and load cycle to momentarily prevent the slide from returning to its forward position after the slide reaches the predetermined mid or half-cocked position shown in FIG. 3, unless and until the slide reaches its rearward position indicating that the launcher apparatus is fully cocked as shown in FIG. 4. After reaching the rearward position, the slide assembly may then be moved to the forward position shown in FIGS. 1 and 2. Blocking the slide from moving forward before the launcher apparatus is fully cocked prevents more than one dart from entering a breech of the launcher apparatus, and thereby facilitates the launcher apparatus's operation and helps prevent jamming of the launcher apparatus. The NERF brand toy darts used in the launcher apparatus are made from a very soft foam material and two darts may easily be squeezed together if not properly handled by the launcher apparatus. Real rifles generally do not have such problems because real cartridges are made of metal and they typically do not compress and distort one another.

Figure 5:
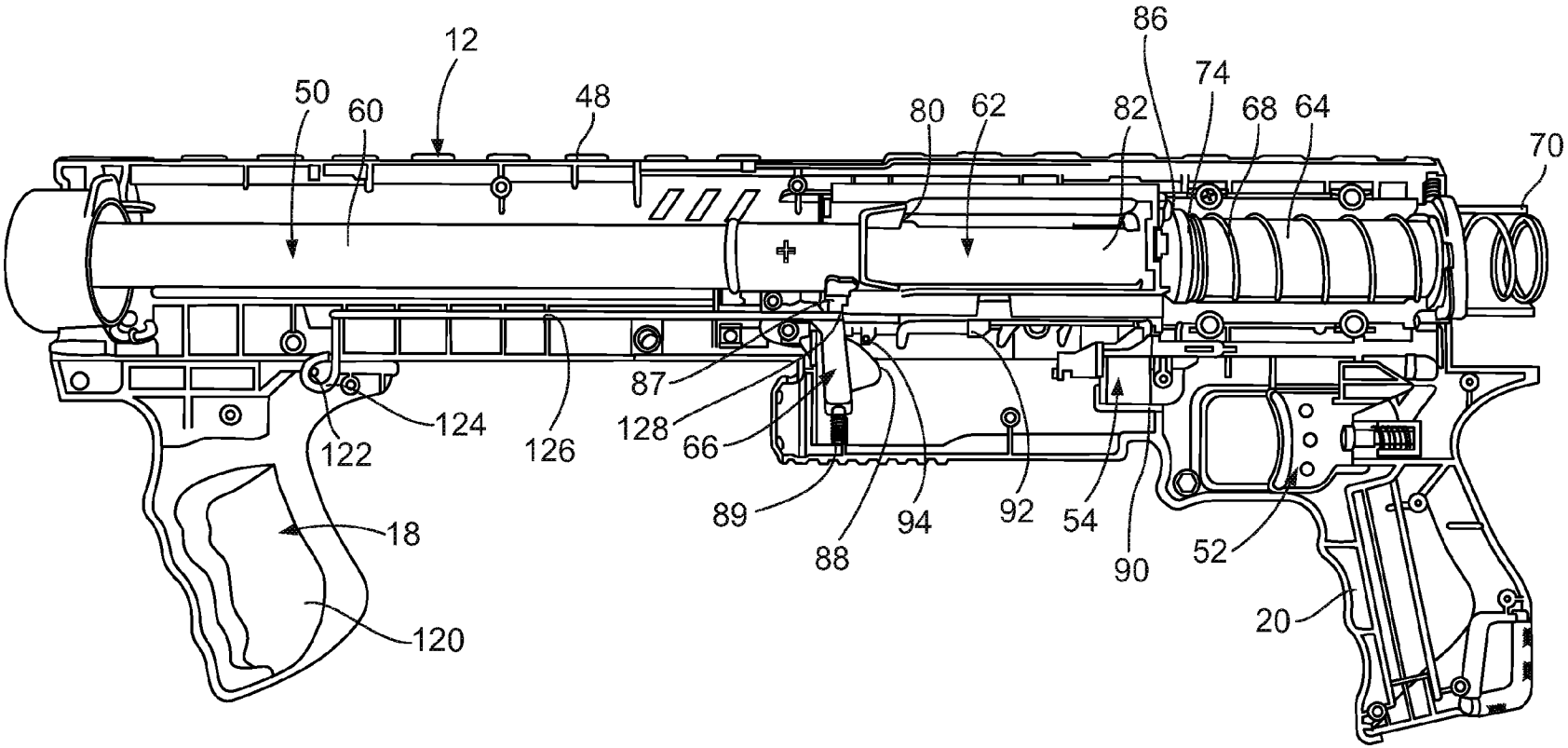
FIG. 5 is a side isometric view of the toy launcher apparatus like that shown in FIG. 2, but with part of a housing removed to illustrate internal structures and assemblies.

Referring now to FIG. 5, the launcher apparatus is shown in a cycle starting configuration, with various interior structures and assemblies being illustrated. The view of the interior of the launcher apparatus shown in FIG. 5, results by removing half of the outer housing 12 and by removing the magazine 28, so that only the remaining half 48 of the housing 12 is illustrated. The structures comprising each interior assembly have been generally, and somewhat randomly, divided and assigned for clarity and convenience, and are not in any way limiting. The assemblies as described in the first embodiment are a barrel assembly 50, the slide assembly 18, a firing assembly 52 and a lock assembly 54. The barrel assembly 50 is mounted to the interior of the housing 12 and includes a tube section 60 mounted in the forward portion of the launcher apparatus, a frame section 62 mounted forward of the pistol grip 20, a rear tube section 64 mounted above the pistol grip 20, a spring biased dart barrier 66 mounted adjacent to the frame section 62, and a launch spring 68. The launch spring 68 is mounted around the rear tube section 64 and is retained on one side between a rear end portion 70 of the housing and a rear cap 72, FIG. 2, and on the other side, by a ring shaped flange 74, also known as a fourth structure in the claims, attached to or made part of the rear tube section 64.

In the alternative, the barrel assembly may include only the tube section 60 and may be referred to as the barrel, and the frame section 62 may be considered part of the slide assembly. The launch spring 68 and rear tube section 64 may also be considered part of the slide assembly or of the firing assembly.

The forward located tube section 60 of the barrel assembly 50 is generally fixed in the housing 12 and is stationary during operation. The frame section 62 includes two portions, a breech portion 80 and a tubular portion 82, and these move between forward and rearward positions as shown by a comparison of FIG. 5 with FIG. 7. The rear tube section 64 also moves between forward and rearward positions as shown by a comparison of FIG. 5 with FIG. 7. The breech portion 80 includes a forward part of the tubular portion 82 that opens to receive a toy dart from the magazine after the breech portion 80 moves rearward. The rearward part of the tubular portion 82 is located within the rear tube section 64 and they also move rearward simultaneously as the frame section moves rearward. The rear tube section 64 includes an upstanding tab 86 for engaging the firing assembly 52 as will be explained in more detail below.

When cocking the launcher apparatus, most of the frame section 62 moves rearward as does the rear tube section 64. The rearward movement of the rear tube section compresses the launch spring 68 between the ring flange 74 and the end portion/end cap 70, 72, and opens the breech portion 80. Once the launch spring 68 is fully compressed, the launcher apparatus is cocked and thereafter, the frame section 62 is moved forward to close the breech, and the forward part of the tubular portion 82 of the frame section 62 returns to the starting or forward position. The rear tube section 64, however, remains in its rearward position being restrained by the firing assembly 52, as will also be explained in more detail below. The spring biased dart barrier 66 includes an upstanding hand element 87 to block the breech portion, and a slanted surface 88 for engaging the frame assembly 62. The dart barrier 66 is moveable between upper and lower positions with a barrier spring 89 biasing the dart barrier 66 to its upper, dart blocking position.

Figure 6:
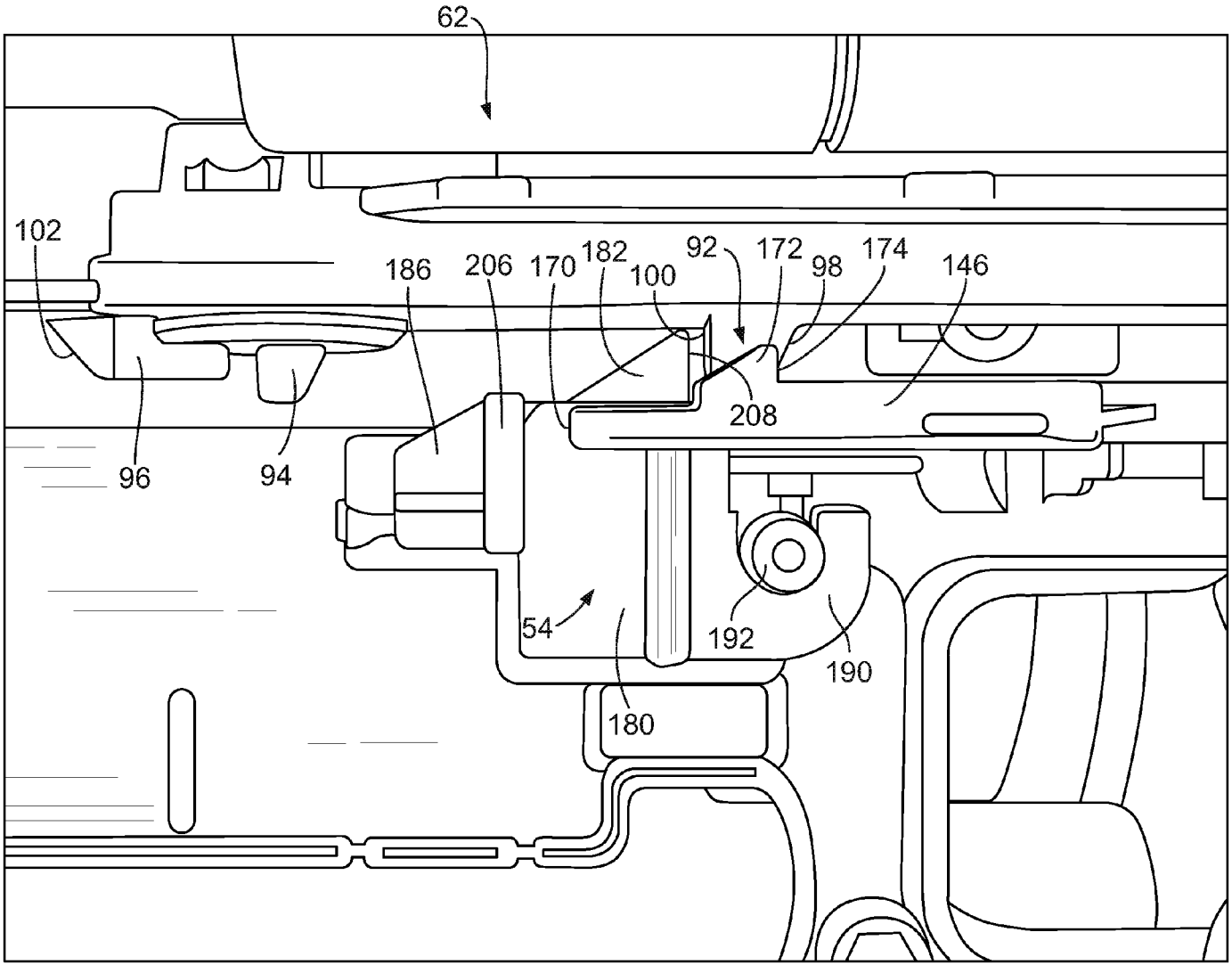
FIG. 6 is a very enlarged view of a portion of the toy launcher apparatus shown in FIG. 5.

The frame section 62 includes a rearward located, depending protrusion 90, FIG. 5, a mid located, short, depending protrusion 92, also known as a first structure in the claims, and first and second forward located, depending protrusions 94, 96, FIGS. 5 and 6. The rear protrusion 90 is generally rectangular in shape in elevation and engages a part of the firing assembly for resetting the lock assembly. The mid protrusion 92 includes a slanted surface 98, FIG. 6, and a vertical surface 100. The slanted surface 98 functions to engage and move the lock assembly out of the way for passage of the frame section 62 when the launcher apparatus is cocked, and the vertical surface 100 is for abutting the lock assembly should a user attempt to reverse the movement of the slide assembly 18, that is, should the user try to move the frame section forward before first completing the full rearward motion of the slide assembly. The first forward protrusion 94, also known as the second structure in the claims, functions to engage the lock assembly, however, the first forward protrusion 94 extends further downward or is longer than the short protrusion 92 and, as such, will disengage the lock assembly, whereas the short protrusion 92 only momentarily depresses an element of the lock assembly until the protrusion 92 passes. The second forward protrusion 96 includes a slanted surface 102, FIG. 6, for engaging the slanted surface 88 of the dart barrier 66 to move the dart barrier downward out of the breech.

The slide assembly 18 includes a grip handle 120, FIG. 5, which includes a post 122 fixed to or made part of the grip handle. Looped around the post 122 is a forward end 124 of a slide rod 126. A rearward end 128 of the slide rod 126 is attached to the frame section 62 of the barrel assembly 50 and causes the frame section 62 to move forward and rearward in direct response to movement of the grip handle 120 by an operator. The grip handle 120 is mounted to the housing 12 and is guided by oppositely disposed grooves in the housing, of which one guide groove 130 is shown in FIGS. 3 and 4. Moving the grip handle to its rearward position cocks the launcher apparatus and thereafter, returning the grip handle to its forward position loads a toy dart.

Figure 7:
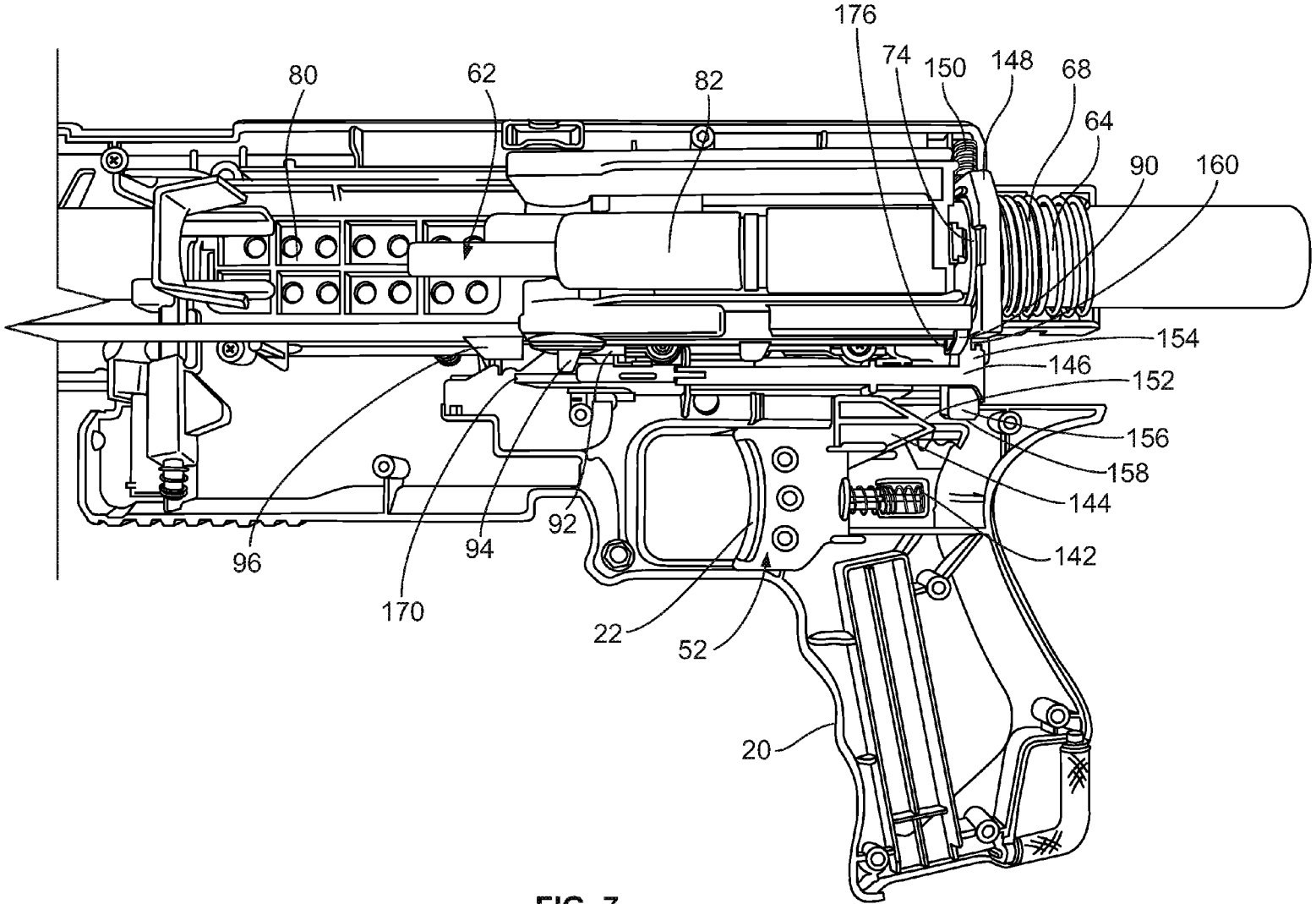
FIG. 7 is a somewhat enlarged view of a portion of the toy launcher apparatus shown in FIG. 5.
Figure 10:
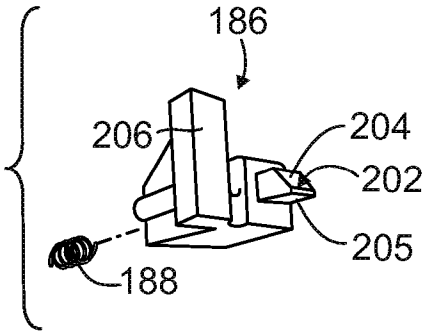
FIG. 10 is a rear isometric view of a second bar of the lock shown in FIGS. 8 and 9.
Figure 9:
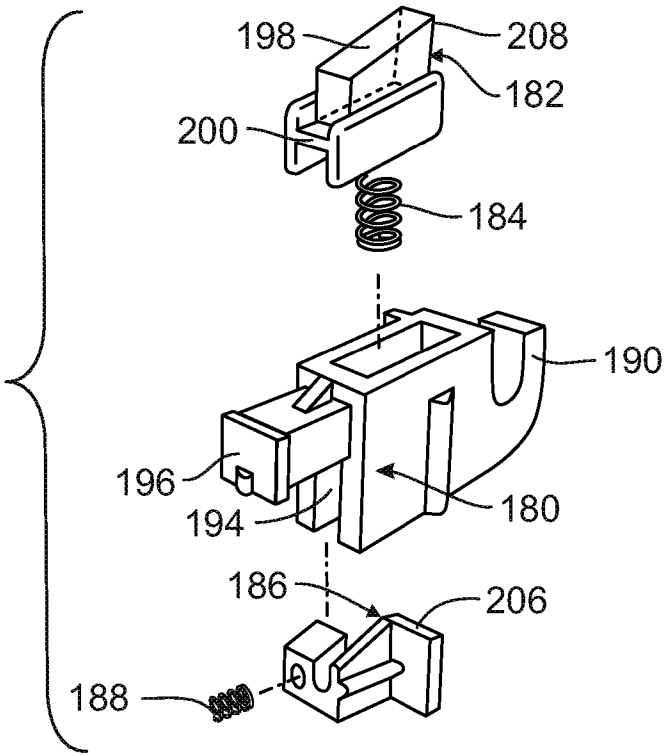
FIG. 9 is an exploded isometric view of the lock of the toy launcher apparatus.
Figure 8:
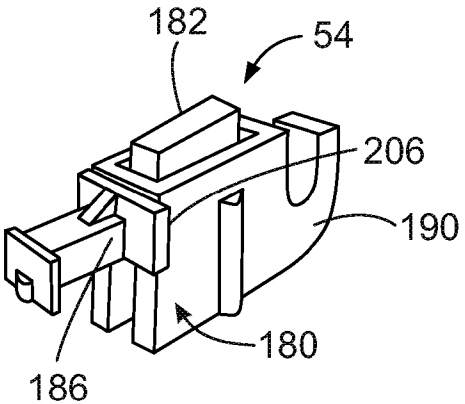
FIG. 8 is an enlarged isometric view of a lock of the toy launcher apparatus.

The pistol grip 20 may be formed as part of the housing 12 and provides a mounting for the firing assembly 52. As illustrated in FIG. 7, the firing assembly 52 also includes the trigger 22, a trigger biasing spring 142, a trigger cam 144, a sliding trigger link 146, a ring shaped latch 148 and a latch biasing spring 150. The trigger 22 has a conventional shape, is mounted in the housing, and moves between forward and rearward positions with the trigger spring 142 biasing the trigger 22 to its forward position as shown in FIGS. 5 and 7. The trigger 22 may be formed with the trigger cam 144, and the trigger cam has a slanted surface 152 for selectively engaging the trigger link 146. The trigger link 146 includes a rear end portion 154 with a vertically directed sliding member 156 having a bottom end 158 for engaging the slanted surface 152 of the trigger cam 144, and a top end 160 for engaging the ring latch 148. The trigger link 146 also includes a forward located vertical end surface 170, FIG. 6, also known as a third structure in the claims, for resetting the lock assembly, and an upstanding tab 172 that functions to engage the rear protrusion 90 of the frame section 62. The ring latch 148 is also mounted in the housing 12 and moves between lower and upper positions with the latch spring 150 biasing the ring latch 148 to the lower position. The ring latch 148 includes a small groove, not shown, that engages the tab 86 of the rear tube section 64.

When the trigger 22 is squeezed by an operator to move the trigger to its rearward position while compressing the trigger biasing spring 142, the slanted surface 152 of the trigger cam 144 moves or cams the sliding member 156 of the trigger link 146 upward to lift the ring latch 148 so as to disengage the upstanding tab 86 on the rear tube section 64. When this occurs the compressed launch spring 68 is released causing the rear tube section 64 to quickly return to its forward position and thereby increase the pressure of air in the tubular portion 82 of the frame section 62. The suddenly increased air pressure launches the dart located in the breech 80. The trigger spring 142 automatically biases the trigger 22 back to its forward position when the operator's pressure is released, and the latch spring 150 biases the ring latch to its lower position.

The upward directed tab 172, FIG. 6, of the trigger link 146 includes a vertical surface 174 that functions to engage with a front surface 176, FIG. 7, of the rear protrusion 90 of the frame section 62. Thus, the frame section moves the trigger link to the left when the slide assembly returns to its forward position. When the trigger link moves to the left, the end surface 170 functions to engage the lock assembly 54 for resetting the lock assembly, while the second forward protrusion 96 of the frame section 62 moves the dart barrier 66 to its lower position while compressing the barrier spring 89.

The lock or lock assembly 54, shown in FIGS. 6-10, includes a lock housing 180 mounted to the launcher apparatus housing 12, a spring biased main abutment surface in the form of a latch or bar 182 moveable between first, upper or extended and second, lower or contracted positions with a biasing main bar spring 184 pushing the main bar to the upper position. A second abutment surface or bar 186 is mounted in the lock housing 180 for movement between first, forward or contracted and second, rearward or extended positions with a second bar spring 188 biasing the second bar 186 to the rearward position. The lock housing 180 includes a rearward located hook 190 for engaging a launch apparatus housing post 192 formed with the launcher apparatus housing to prevent forward or rearward movement of the lock housing. The lock housing 180 also includes a vertically directed slot 194 facilitating assembly of the second bar 186 with the lock housing, and a forward located wall 196 for restraining the second bar spring 188. The lock assembly primary function is to operatively connect to the slide assembly to enable the slide assembly to move from its forward position toward its rearward position and to prevent the slide assembly from moving back to the forward position after the slide assembly has moved rearward a predetermined distance until after the slide assembly has reached the rearward position.

During factory assembly, the main bar 182 and the biasing spring 184 are inserted into the lock housing 180. Thereafter, the second bar spring 188 is connected to the second bar 186 and both the second bar spring and the second bar are inserted into the lock housing. The main bar 182 is formed with a sloping upper surface 198 to engage the sloping surface 98 of the mid protrusion 92 of the frame section 62 during a cocking portion of the cock and load cycle, and a forward facing flange 200 for selectively engaging the second bar 186. The second bar 186 is formed with a rearward extending tab 202 having a sloping surface 204 which functions to allow the flange 200 to pass by as it depresses, and thereafter, to engage the flange 200 of the main bar 182 with a surface 205. The second bar 186 also includes a side panel 206 that is biased by the second bar spring 188 which functions to engage the vertical surface 170 of the trigger link 146 of the firing assembly 52.

During rearward movement of the frame section 62, the sloping surface 98 of the mid protrusion 92 partially and momentarily depresses the main bar 182 downward. The main bar 182 moves downward so as to not interfere with the rearward movement of the frame section 62. However, once the frame section is passed the main bar 182, the partially depressed main bar raises upward under the influence of the main bar spring 184 to the main bar's upper position to present a blocking vertical surface 208 to the vertical surface 100 of the mid protrusion 92. Should the user of the launcher apparatus attempt to move the slide assembly 18 forward after just a half cock or some other predetermined distance, the surfaces 100 and 208 will abut and forward movement of the slide assembly will be prevented. The described lock or blocking arrangement of the slide assembly prevents more than one dart from being loaded into the breech.

In order for the launcher apparatus to discharge a toy dart, the slide assembly 18 must be moved to the rearward position to fully cock the launch apparatus, and then the slide assembly 18 must be returned to the forward position to properly load a toy dart. When the frame section is moved forward, the rear protrusion 90 of the frame section 62 engages the tab 172 of the trigger link 146 and moves the trigger link forward to have the end surface 170 engage the side panel 206 of the second bar 186. When engaged, the side panel 206 of the second bar moves the second bar 186 forward to disengage the second bar from the flange 200 of the main bar 182. This movement enables the main bar 182 to move upward to its upper position under the biasing influence of the main bar spring 184. Hence, the lock assembly is reset and is ready for the next cock and load cycle of the launcher apparatus.

In the alternative, see U.S. Pat. No. 7,287,526, owned by the assignee of the present disclosure, for variations of the structural assemblies, such as a different firing assembly and a different slide assembly. The disclosure of U.S. Pat. No. 7,287,526 is incorporated herein by reference.

In beginning a detailed description of the operation of the toy launcher apparatus 10 having the lock assembly 54, it is convenient to start with the launcher apparatus as it appears in FIG. 2, namely, at the start of a cock and load cycle. A user typically will hold the launcher apparatus with one hand on the pistol grip 20 and the other hand on the slide assembly 18. To prepare for discharge of the toy dart 30, a user must fully cock the launcher apparatus by moving the slide assembly from its forward position, illustrated in FIG. 1, to its rearward position, illustrated in FIG. 4. During the rearward movement of the slide assembly, the mid protrusion 92 of the frame section 62 engages the main bar 182 of the lock assembly 54. The main bar is momentarily and partially depressed from its upper position toward, but not reaching, its lower position to allow the frame section to pass rearward, thereby allowing the slide assembly 18 to reach its rearward position so as to fully cock the launcher apparatus. Once the mid protrusion 92 has passed the main bar 182, the main bar returns to its upper position under the influence of the biasing main bar spring 184. As the launcher apparatus reaches the fully cocked configuration, the first forward protrusion 94 of the frame section 62 reaches and engages the main bar causing the main bar to be depressed for a second time. However, because the first forward protrusion 94 is vertically longer than the mid protrusion 92 by a predetermined amount, the main bar is moved from its upper position to its lower position while compressing the main bar spring 184. When the main bar is in its lower position, the main bar will become restrained and be prevented from returning to its upper position by the second bar 186. As the main bar is moved downward, the second bar engages the flange 200. Once the flange passes below the second bar, the second bar spring moves the second bar from its forward, contracted position to its rearward, extended position, and into an abutting relationship with the flange of the main bar to prevent the main bar from returning to its upper position.

After reaching the fully cocked rearward configuration, the user returns the slide assembly to its forward position. The forward motion of the slide assembly also moves the frame section forward and causes three engagements to occur. The second forward protrusion 96 moves the dart barrier 66 to its lower position so that the toy dart is free to be discharged. The rear protrusion 90 engages the upper tab 172 of the trigger link 146 to move the trigger link forward, and when the trigger link is moved forward the end surface 170 of the trigger link engages the side panel 206 of the second bar 186 causing the second bar to move forward and disengage from the flange 200 of the main bar. Disengagement of the second bar releases the main bar to move to its upper position and thereby be reset for the next cycle.

Figure 11:
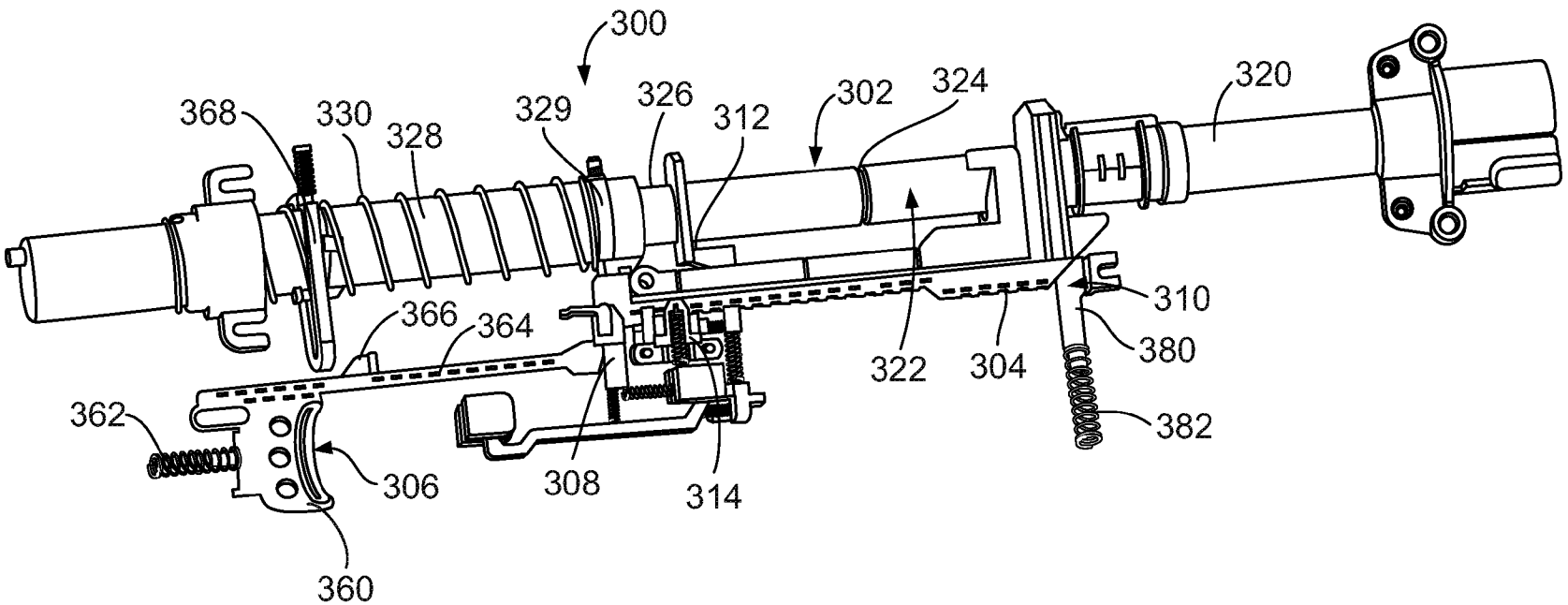
FIG. 11 is a side isometric view of another embodiment of the toy launcher apparatus with internal structures and assemblies.
Figure 12:
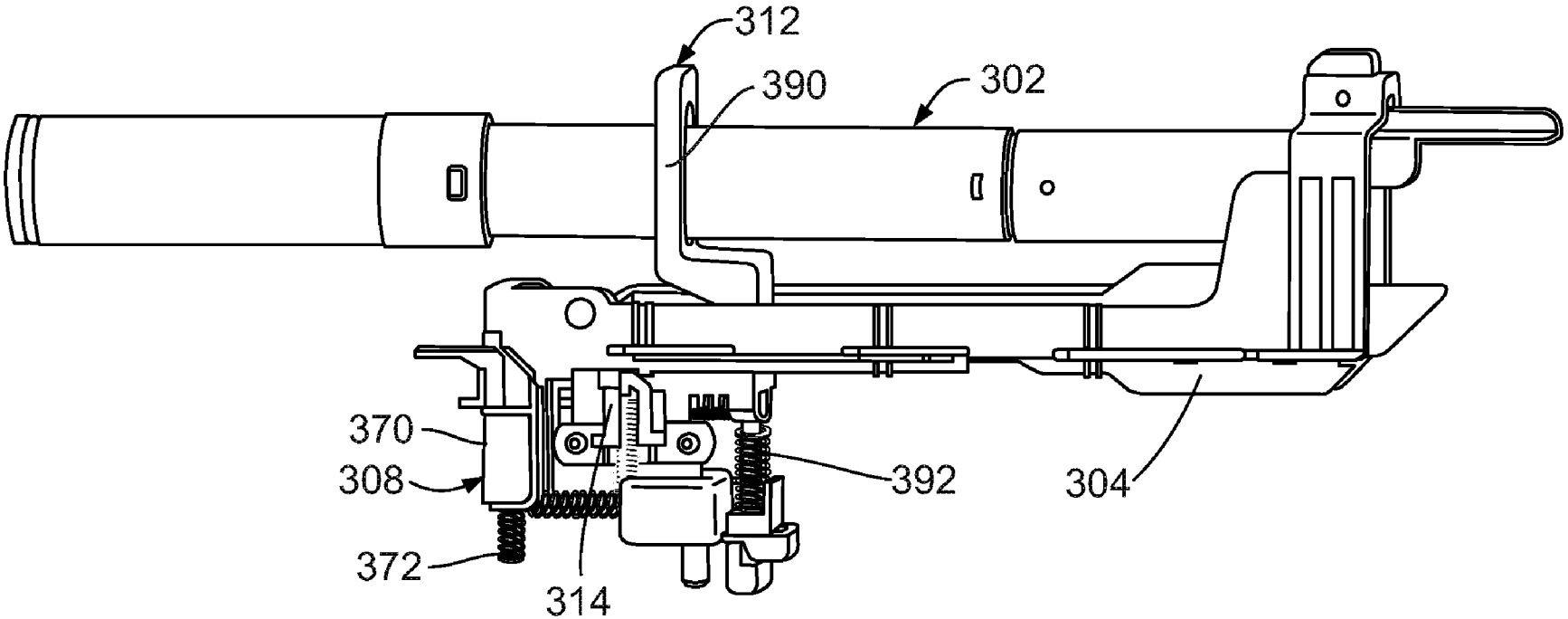
FIG. 12 is an enlarged side isometric view of a portion of the internal structures and assemblies shown in FIG. 11.

Referring now to FIGS. 11-16, there is shown another embodiment of a launcher apparatus 300 of the present invention. Illustrated in FIG. 11 are internal structures or assemblies of the alternative launcher apparatus embodiment. An outer housing, which may be similar to the outer housing 12, has been removed for clarity. The structures and assemblies include a barrel or barrel assembly 302, a slide or slide assembly 304, a firing assembly 306, a firing assembly lock 308, a barrel barrier assembly 310, a toy dart safety assembly 312, and a slide lock or slide lock assembly 314. It is noted that the attitude of the launcher apparatus embodiment 300 shown in FIGS. 11-15 is rotated 180° from the embodiment shown in FIGS. 2-7. The drawing of the launcher apparatus in FIG. 16, however, is rotated 180° from the drawings of the launcher apparatus shown in FIGS. 11-15.

The launcher apparatus 300 is similar in construction to the launcher apparatus 10 and operates generally in a similar manner. The launcher apparatus 300 must also complete a cock and load cycle before a toy dart may be discharged. To achieve such a cycle, the slide assembly must be moved fully rearward and then brought fully forward by a user as already described in detail above in relation to the first embodiment. To reduce the likelihood of jamming, the launcher apparatus 300 includes the slide lock or slide lock assembly 314. In addition, the launcher apparatus 300 includes the firing assembly lock 308, the barrel barrier assembly 310, and the dart safety assembly 312.

The barrel assembly 302 includes a forward located tube section 320, a breech section 322, which includes two portions, a breech portion 324 and a tubular portion 326, and these move between forward and rearward positions. The barrel assembly also includes a rear tube section 328 with a fourth structure or flange 329, that moves between forward and rearward positions, and a launch spring 330. These elements operate like those already described for the launcher apparatus 10.

Figure 13:
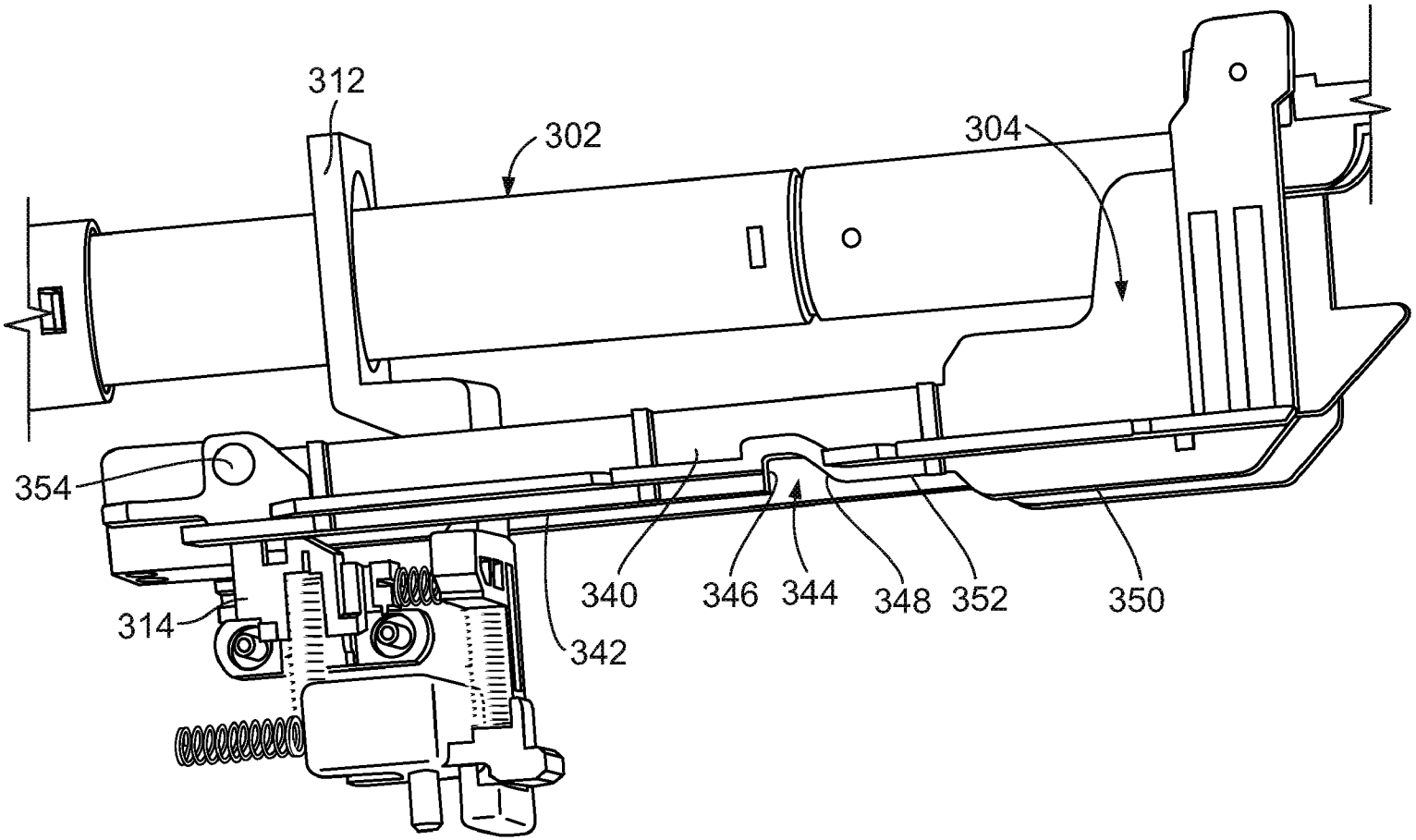
FIG. 13 is an enlarged side isometric view of a portion of the internal structures and assemblies shown in FIG. 12.

The slide assembly 304 includes a slide element 340, FIG. 13, having a first structure or depressing slide surface 342, a notch 344 with a vertical surface 346 and a slanted surface 348, a forward located depression surface 350 and a mid level surface 352. The vertical surface 346, the slanted surface 348, the depression surface 350 and the mid level surface 352, all function to selectively engage the slide lock assembly 314 causing an element of the slide lock assembly to be in an upper position, a lock position, a partially depressed position, and a fully depressed and locked position. The slide assembly 304 also includes a grip, not shown, but which would attach to the slide assembly through an opening 354.

The firing assembly 306, FIG. 11, includes a trigger 360 movable between forward and rearward positions, a trigger spring 362 for biasing the trigger to the forward position, and a trigger link 364, also movable between forward and rearward positions. The trigger link 364 includes an upstanding tab 366 for engaging a ring shaped latch 368 that operates to first restrain and then to release the compressed launch spring 330. The firing assembly lock 308 includes a block element 370, FIG. 12, movable between upper and lower positions and a block element spring 372 for biasing the block element from the lower blocking position to an upper unblocking position. After a lock and load cycle, when pressure is placed on the trigger 360 by an operator, the trigger moves to its rearward position while compressing the trigger biasing spring 362. The tab 366 of the trigger link 364 moves or cams the ring latch 368 upward to disengage the launch spring 330, to provide energy to discharge a toy dart.

The barrel barrier assembly 310 includes a blocking element 380, FIG. 11, movable between upper and lower positions and a spring 382 biasing the blocking element to the upper unblocking position from a lower blocking position. The toy safety assembly 312 includes an arm 390, FIG. 12, movable between upper and lower positions and a spring 392 for biasing the arm to an upper releasing position from a lower locking position.

Figure 14:
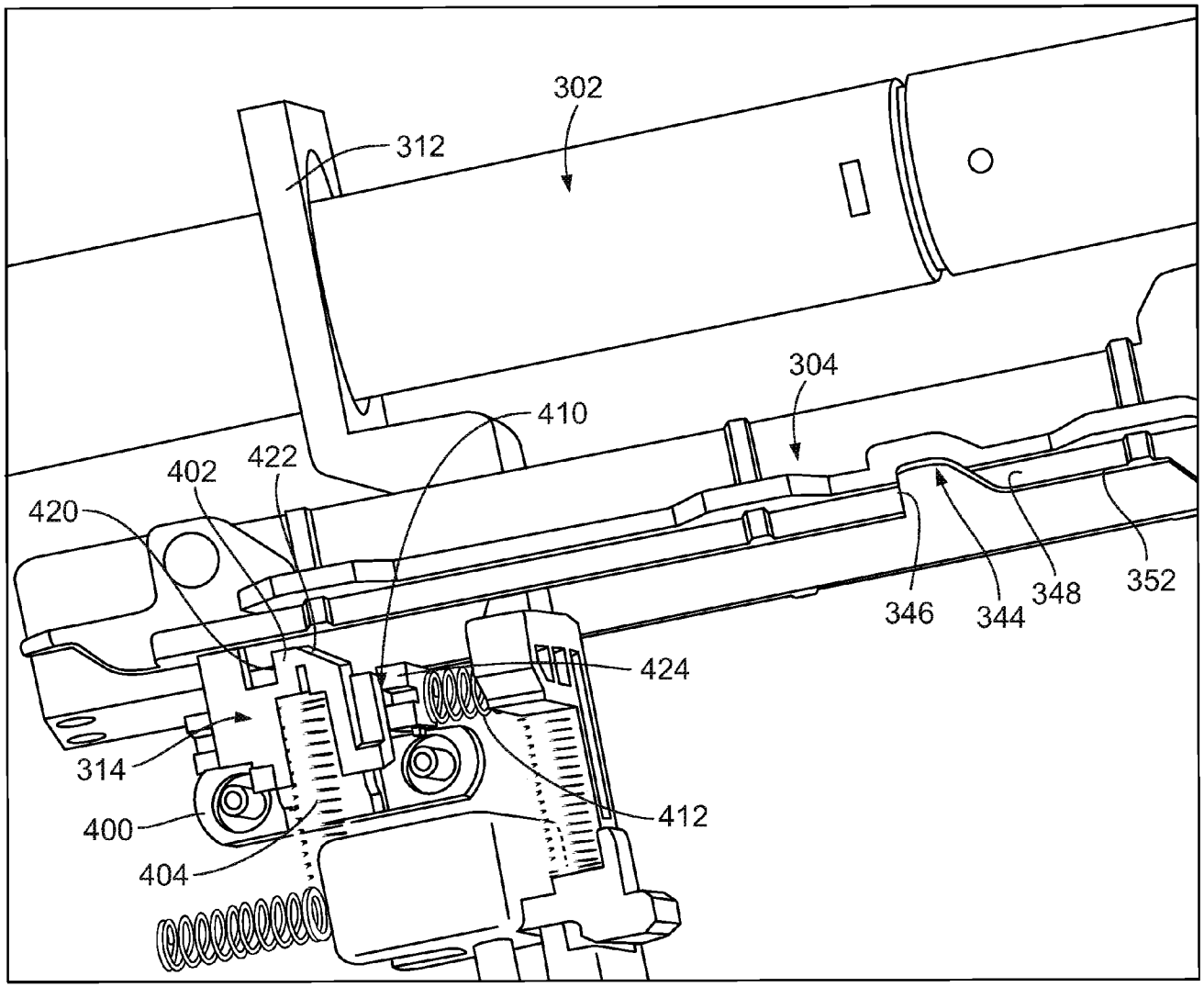
FIG. 14 is an enlarged side isometric view of a portion of the internal structures and assemblies shown in FIG. 13.
Figure 15:
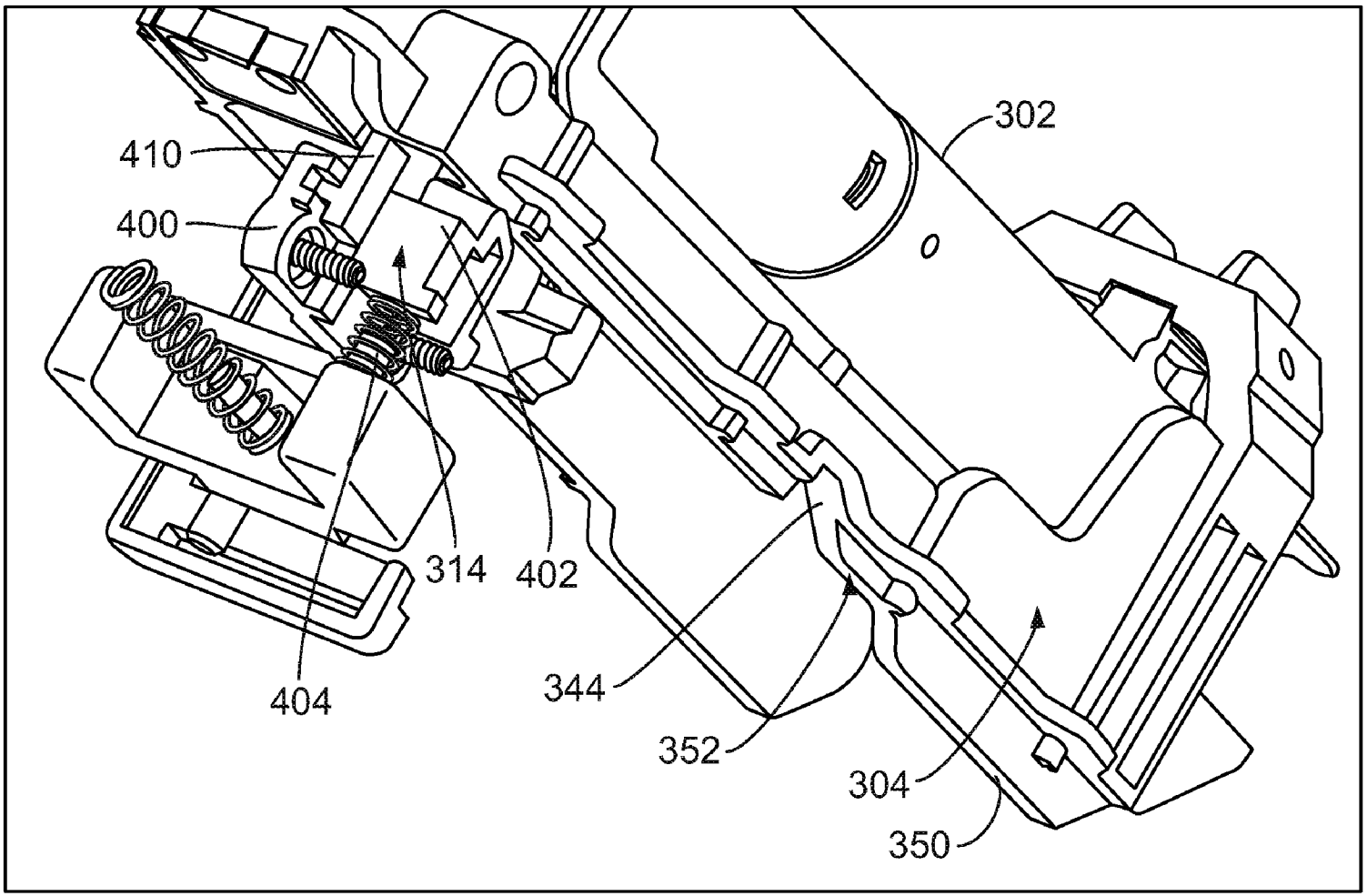
FIG. 15 is a rear isometric view of the portion of the internal structures and assemblies shown in FIG. 14.
Figure 16:
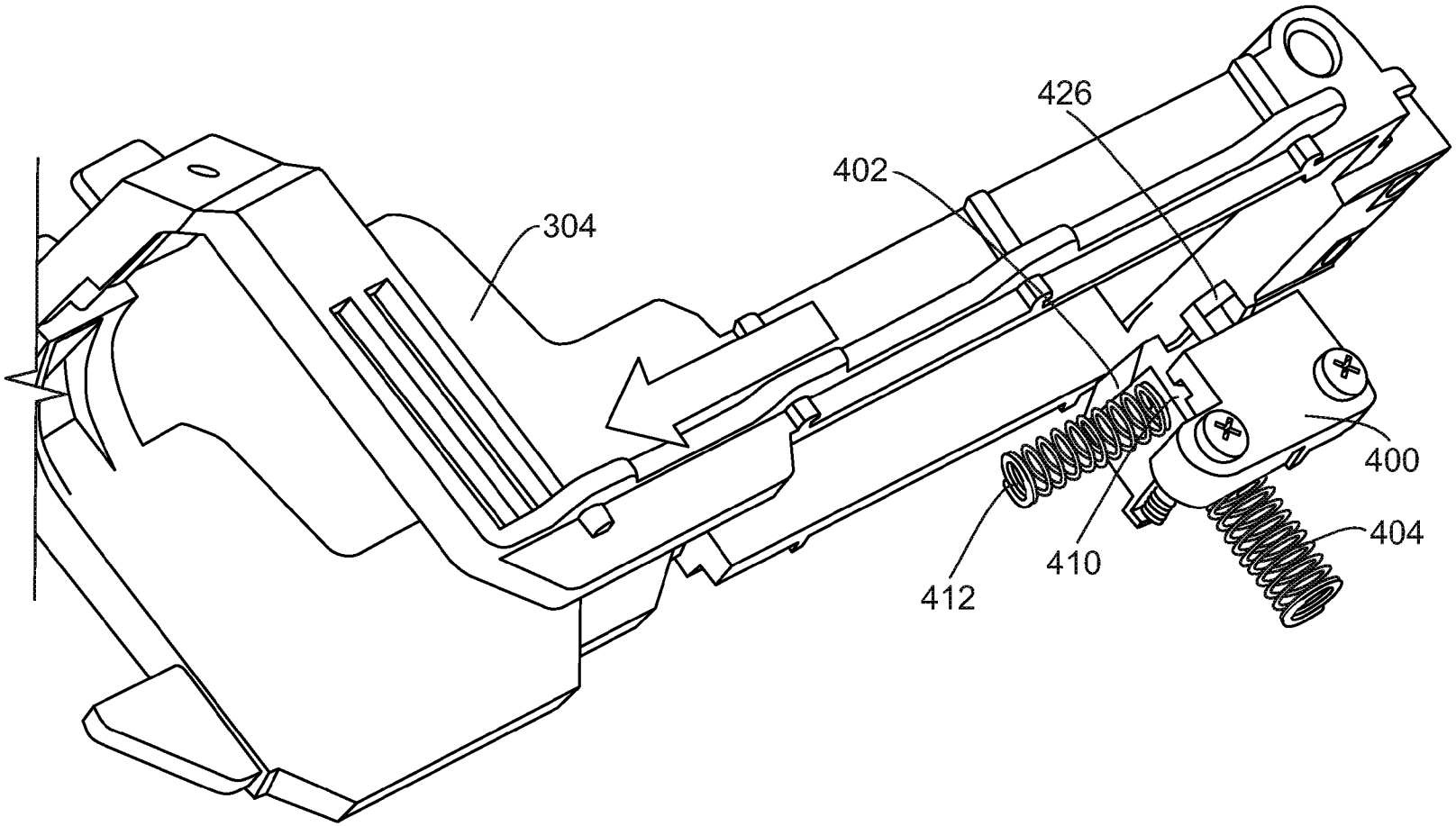
FIG. 16 is a front isometric view of the portion of the internal structures and assemblies shown in FIG. 15.

The slide lock assembly 314, FIGS. 14-16, includes a retainer element 400 connected to the housing of the launcher apparatus 300, a main lock bar or latch 402 mounted by the retainer and moveable between upper or extended, partially lowered, and lowered or contracted positions with a main latch spring 404 biasing the main latch to the upper locking position to prevent the slide assembly 304 from moving forward after it has moved partially rearward, to the half cocked or some other predetermined position. A second lock bar or latch 410 is connected to the retainer element for movement between forward or contracted and rearward or extended positions with a second latch spring 412 biasing the second latch to the rearward or extended position. The main latch 402 includes a vertical surface 420 that functions to abut the vertical surface 346 of the slide assembly 304 and prevent forward movement of the slide assembly after the slide assembly has reached the predetermined, half cocked position, and a slanted surface 422 for engaging the slanted surface 348 of the slide assembly to depress the main latch as the slide assembly moves rearward during its cocking cycle. As the slide assembly continues to move rearward, the main latch engages the mid level surface 352 and then the depression surface 350 of the slide assembly. The depression surface 350 depresses the main latch to its lowered position.

The second latch 410 functions to engage the main latch 402 in a manner similar to the second bar 186 engagement of the main bar 182 of the first embodiment. When the main latch 402 is momentarily depressed part way, the second latch 410 does not restrain the main latch from influence by the biasing latch spring 404. However, when the depression surface 350 of the slide assembly engages the main latch 402, the main latch is depressed to its lowered position and the second latch 410 is able to engage the main latch to prevent the main latch from returning to its upper position. The second latch includes an arm 424, FIG. 14, that is engaged by a third structure or finger element 426, FIG. 16, of the slide assembly 304, as the slide assembly moves forward after cocking the launcher apparatus. Engagement of the arm 424 and the finger element 426 causes the second latch 410 to disengage from the main latch 402 and allows the main latch spring 404 to move the main latch to its upper position and acts as a reset. The slide lock assembly 314 operates very much like the lock assembly 54 of the first embodiment, in that the lock assembly prevents a return of the slide assembly until after the slide assembly is fully cocked, the lock assembly is moved out of the way of the slide assembly to allow forward movement, and then the lock assembly is released or reset for the next cycle.

In operation of the toy launcher apparatus 300, the description starts with the launcher apparatus in the configuration shown in FIG. 11, at the start of a cock and load cycle. To prepare for discharge of a toy dart, a user must cock the launcher apparatus by moving the slide assembly 304 from its forward position as shown, to its rearward position when the launch spring is compressed. As the notch 344 of the slide assembly reaches the slide lock assembly 314, the main latch 402 moves to its fully upper position to prevent the slide assembly from moving forward until the slide assembly first reaches its rearward position to complete cocking of the launcher apparatus. As the slide assembly continues to move rearward, the main latch moves beyond the notch and engages the mid level surface 352 and then the depression surface 350. The depression surface moves the main latch 402 to its lowered position where it is engaged and restrained by the second latch 410. When the slide assembly is returned to its forward position, the launcher apparatus is loaded. At the end of the return movement of the slide assembly, the finger element 426 of the slide assembly engages the second latch 410 to enable release of the main latch 402. Forward movement of the slide assembly also causes a change in position of the safety assembly, the barrier assembly and the firing lock.

The toy launcher apparatus disclosed in detail above have great play value because they simulate real Tommy guns and operate like real pump action rifles, but do so safely, and with robust structures that are easy to use and to produce at reasonable cost.

From the foregoing, it can be seen that there has been provided features for an improved toy and a method for momentarily blocking a movable structure to prevent jamming. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launcher apparatus comprising:

a barrel structured to receive toy projectiles;

a firing structure operatively connected to the barrel to enable the toy projectiles to be discharged from the launcher apparatus;

a slide operatively connected to the firing structure to enable a launch spring to be compressed, the slide being moveable between a forward position and a rearward position; and a lock structure operatively connected to the slide to enable the slide to move from the forward position toward the rearward position and to prevent the slide from moving back to the forward position after the slide has moved rearward to a half cocked position until after the slide has reached the rearward position.

2. The toy launcher apparatus of claim 1, wherein:

the lock structure operates to momentarily prevent the slide from moving back to the forward position after the slide has moved rearward to the half cocked position until after the slide has reached the rearward position, to be moved out of the way to allow the slide to move from the rearward position to the forward position, and to reset itself.

3. The toy launcher apparatus of claim 1, wherein:

the lock structure includes a spring biased main abutment surface to engage the slide, the main abutment surface being movable between first and second positions.

4. The toy launcher apparatus of claim 3, wherein:

the lock structure includes a spring biased second abutment surface; and the second abutment surface restrains the main abutment surface in the second position.

5. The toy launcher apparatus of claim 4, wherein:

the lock structure includes a first spring for biasing the main abutment surface and a second spring for biasing the second abutment surface.

6. The toy launcher apparatus of claim 5, including:

a first structure operatively connected to the slide to enable depression of the main abutment surface from the first position.

7. The toy launcher apparatus of claim 6, including:

a second structure operatively connected to the slide to enable depression of the main abutment surface to the second position.

8. The toy launcher apparatus of claim 7, including:

a third structure operatively connected to enable movement of the main abutment surface from the second position to the first position.

9. The toy launcher apparatus of claim 8, including:

a fourth structure operatively connected to the slide for compressing the launch spring.

10. The toy launcher apparatus of claim 9, wherein:

the first, second, and third structures are mounted to operatively engage the lock structure as the slide moves from the forward position to the rearward position and back to the forward position.

11. A toy launcher apparatus comprising a lock operatively connected to a slide to enable the slide to be moved from a first position to a second position, and to enable return movement of the slide to the first position after the slide reaches the second position, said lock being located between the first and second positions of the slide and operatively connected with the slide to momentarily prevent return movement of the slide to the first position after the slide reaches a predetermined position between the first and the second positions when the slide moves from the first position to the second position.

12. The toy launcher apparatus of claim 11, wherein:

the lock includes a spring biased main abutment surface movable between a first and a second lock positions.

13. The toy launcher apparatus of claim 12, wherein:

the lock includes a spring biased second abutment surface; and the second abutment surface restrains the main abutment surface in the lock second position.

14. The toy launcher apparatus of claim 13, including:

a first structure operatively connected to the slide to enable movement of the main abutment surface from the lock first position toward the lock second position.

15. The toy launcher apparatus of claim 14, including:

a second structure operatively connected to the slide to enable movement of the main abutment surface to the lock second position.

16. The toy launcher apparatus of claim 15, including:

a third structure operatively connected to the slide to enable movement of the main abutment surface from the lock second position to the lock first position.

17. The toy launcher apparatus of claim 16, including:

a link operatively connected to the lock to enable the third structure to move the second abutment surface.

18. The toy launcher apparatus of claim 17, including:

a fourth structure operatively connected to the slide for compressing a launch spring.

19. A toy launcher apparatus comprising:

a first assembly for receiving one or more toy projectiles;

a second assembly connected to the first assembly whereby the one or more toy projectiles are discharged from the launcher apparatus;

a third assembly connected to the first and second assemblies for cocking the toy launcher apparatus and for loading the one or more toy projectiles;

an abutment surface at the third assembly;

a lock assembly comprising a first lock assembly abutment surface at the abutment surface of the third assembly whereby the third assembly is moved from a first position to a second position, with a return movement of the third assembly to the first position after the third assembly reaches the second position; and a spring biasing element with the first lock assembly abutment surface preventing return movement of the third assembly to the first position after the third assembly reaches a predetermined position between the first and the second positions when the third assembly moves from the first position to the second position.

20. The toy launcher apparatus of claim 19, wherein the lock assembly comprises a second lock assembly abutment surface restraining the lock assembly at the second position.

* * * * *